US011591185B2

(12) United States Patent
Shi

(10) Patent No.: US 11,591,185 B2
(45) Date of Patent: Feb. 28, 2023

(54) REMOTE TRIGGERING DEVICE, OVERSPEED GOVERNOR ASSEMBLY AND ELEVATOR SYSTEM

(71) Applicant: Otis Elevator Company, Farmington, CT (US)

(72) Inventor: Zhengbao Shi, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 414 days.

(21) Appl. No.: 16/594,804

(22) Filed: Oct. 7, 2019

(65) Prior Publication Data

US 2020/0109032 A1 Apr. 9, 2020

(30) Foreign Application Priority Data

Oct. 9, 2018 (CN) ..... 201811172420.2

(51) Int. Cl.
*B66B 5/04* (2006.01)

(52) U.S. Cl.
CPC ..... *B66B 5/044* (2013.01)

(58) Field of Classification Search
CPC ..... B66B 5/04; B66B 5/044; B66B 5/048; B66B 5/046; B66B 5/0087
See application file for complete search history.

(56) References Cited

U.S. PATENT DOCUMENTS 4,258,832 A 3/1981 Thorp
5,565,660 A * 10/1996 Karner ..... B66B 5/044 187/276
2013/0098711 A1 4/2013 Aguado et al.
(Continued)

FOREIGN PATENT DOCUMENTS

CN 1860077 A 11/2006
CN 1290129 C 12/2006
CN 201395453 Y 2/2010
(Continued)

OTHER PUBLICATIONS

Maruyama, Speed Governing Device of Elevator, Jun. 28, 2012, Machine translation of WO2012086026A1 (Year: 2012).*
(Continued)

*Primary Examiner* — Michael R Mansen
*Assistant Examiner* — Michelle M Lantrip
(74) *Attorney, Agent, or Firm* — Cantor Colburn LLP

(57) ABSTRACT

A remote triggering device, an overspeed governor assembly and an elevator system are provided. The remote triggering device includes: an actuator seat mounted on a fixed bracket and rotatable between a first position and a second position; an actuator disposed on the actuator seat and having an action end movable between a retracted position and an extended position; and a reset lever extending from the actuator seat; wherein in a case that the centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position toward the second position, and the reset lever rotates with the actuator seat.

18 Claims, 10 Drawing Sheets

(56) References Cited

U.S. PATENT DOCUMENTS

| | | | | | |
|---|---|---|---|---|---|
| 2015/0136544 | A1* | 5/2015 | Dube | F16D 3/12 188/180 | |

FOREIGN PATENT DOCUMENTS

| | | | | | |
|---|---|---|---|---|---|
| CN | 102196986 | A | | 9/2011 | |
| CN | 102348626 | A | | 2/2012 | |
| CN | 101821187 | B | | 1/2013 | |
| CN | 103517864 | A | | 1/2014 | |
| CN | 104016205 | A | * | 9/2014 | |
| CN | 104709792 | A | | 6/2015 | |
| CN | 204549707 | U | | 8/2015 | |
| CN | 105460729 | A | * | 4/2016 | |
| CN | 105923491 | A | | 9/2016 | |
| CN | 104837757 | B | | 12/2016 | |
| CN | 106586760 | A | | 4/2017 | |
| CN | 206266033 | U | | 6/2017 | |
| CN | 107021395 | A | | 8/2017 | |
| JP | 2008094544 | A | * | 4/2008 | |
| KR | 100709506 | B1 | | 4/2007 | |
| KR | 20170040434 | A | | 4/2017 | |
| KR | 20170052812 | A | | 5/2017 | |
| TW | M534181 | U | | 12/2016 | |
| WO | WO-2009027576 | A1 | * | 3/2009 | B66B 5/044 |
| WO | 2009130366 | A1 | | 10/2009 | |
| WO | WO-2010084563 | A1 | * | 7/2010 | B66B 5/044 |
| WO | WO-2012086026 | A1 | * | 6/2012 | B66B 5/044 |

OTHER PUBLICATIONS

Shidomi, Elevator Device, Sep. 3, 2014, Machine translation of CN104016205A (Year: 2014).*

Kazuhiko, Takai, Limit Switch Operation Mechanism and Speed Governor Having This Mechanism, Apr. 24, 2008, machine translation of JP 2008094544 A (Year: 2008).*

European Search Report for application EP 19202291.1, dated Mar. 20, 2020, 40 pages.

* cited by examiner

REMOTE TRIGGERING DEVICE, OVERSPEED GOVERNOR ASSEMBLY AND ELEVATOR SYSTEM

FOREIGN PRIORITY

This application claims priority to Chinese Patent Application No. 201811172420.2, filed Oct. 9, 2018, and all the benefits accruing therefrom under 35 U.S.C. § 119, the contents of which in its entirety are herein incorporated by reference.

FIELD OF THE INVENTION

The present disclosure relates to the field of elevator safety, and in particular to an overspeed governor assembly for an elevator and an elevator having the overspeed governor assembly.

BACKGROUND OF THE INVENTION

With the development of the technology of overspeed governor assembly for elevators, the new Car Mounted Governor (CMG) assembly has been more widely used. The CMG governor assembly is more compact in structure than conventional overspeed governor assemblies with or without a machine room. An overspeed governor assembly was disclosed in U.S. Patent No. US 2013/0098711A1 by Aguado, et al., on Apr. 25, 2013, wherein the overspeed governor assembly includes a centrifugal mechanism that is gradually unfolded as the speed of a sheave increases. When the sheave reaches a first speed, an outer side of the centrifugal mechanism toggles an overspeed protection switch, thereby braking the elevator through an electrical mechanism. If the speed of the sheave continues to increase to a second speed, the centrifugal mechanism will drive a core ring on an inner side thereof, thereby triggering a mechanical brake device. After the car is braked and the maintenance on the elevator is completed, the overspeed protection switch needs to be returned to an untriggered position so that the elevator can be re-operated and protection can be provided when the overspeed occurs next time.

Such a car-mounted overspeed governor assembly further includes a remote triggering device, such as the type described in the Chinese utility model No. ZL201621141734.2, entitled "Remote Triggering Device, Overspeed Governor Assembly and Elevator", filed by Otis Elevator Company. The remote triggering device can be actively controlled to act on the centrifugal mechanism so that the overspeed governor assembly can be actively triggered without overspeed of the car for purposes such as testing.

In prior designs, the overspeed protection switch and the remote triggering device are each configured with an actuator such as an electromagnet to implement the above functions.

SUMMARY OF THE INVENTION

An object of the present disclosure is to solve or at least alleviate the problems in the prior art.

According to some aspects, a remote triggering device for an overspeed governor assembly is provided, which includes: an actuator seat mounted on a fixed bracket and rotatable between a first position and a second position; an actuator disposed on the actuator seat and having an action end movable between a retracted position and an extended position; and a reset lever extending from the actuator seat; wherein in a case that the centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position toward the second position, and the reset lever rotates with the actuator seat.

Optionally, in the remote triggering device, in a case that the centrifugal mechanism of the overspeed governor assembly rotates in a second direction corresponding to descending of the elevator car, when the action end of the actuator is in the extended position, the actuator seat is in the first position, and the action end of the actuator acts on the centrifugal mechanism, thereby triggering the overspeed governor assembly.

Optionally, in the remote triggering device, the actuator seat is provided with a return spring so that the actuator seat tends to return to the first position.

Optionally, in the remote triggering device, the actuator seat has a front end and a rear end, and the rear end of the actuator seat has an opening to mount to a support pin on the fixed bracket.

Optionally, in the remote triggering device, the reset lever is fixedly connected to the front end of the actuator seat.

Optionally, in the remote triggering device, the actuator is fixed to a middle portion of the actuator seat, and the middle portion of the actuator seat is provided with an opening to allow the action end of the actuator to pass through.

Optionally, in the remote triggering device, a sidewall of the opening at the rear end of the actuator seat is provided with a notch, the support pin is provided with a stopper to fit into the notch, and the notch is configured to allow the actuator seat to rotate between the first position and the second position.

Optionally, in the remote triggering device, the actuator is an electromagnet, and the electromagnet includes a core rod and a buffer sleeve disposed at an end of the core rod.

In another aspect, an overspeed governor assembly is provided, which includes: a fixed bracket; a sheave mounted on the fixed bracket; a centrifugal mechanism mounted on the sheave and rotating with the sheave; an overspeed protection switch on a radially outer side of the centrifugal mechanism; and a remote triggering device on the radially outer side of the centrifugal mechanism and adjacent to the overspeed protection switch, the remote triggering device including: an actuator seat mounted on the fixed bracket and rotatable between a first position and a second position; an actuator disposed on the actuator seat and having an action end movable between a retracted position and an extended position; and a reset lever extending from the actuator seat; wherein in a case that the centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position to the second position, and the reset lever rotates with the actuator seat, and wherein the reset lever is capable of acting on the overspeed protection switch during rotation so that the overspeed protection switch is returned to an untriggered position.

Optionally, in the overspeed governor assembly, in a case that the centrifugal mechanism of the overspeed governor assembly rotates in a second direction corresponding to descending of the elevator car, when the action end of the actuator is in the extended position, the actuator seat is in the first position, and the action end of the actuator acts on the centrifugal mechanism, thereby triggering the overspeed governor assembly.

Optionally, in the overspeed governor assembly, the actuator seat is provided with a return spring so that the actuator seat tends to return to the first position.

Optionally, in the overspeed governor assembly, the actuator seat has a front end and a rear end, and the rear end of the actuator seat has an opening to mount to a support pin on the fixed bracket.

Optionally, in the overspeed governor assembly, the reset lever is fixedly connected to the front end of the actuator seat.

Optionally, in the overspeed governor assembly, the actuator is fixed to a middle portion of the actuator seat, and the middle portion of the actuator seat is provided with an opening to allow the action end of the actuator to pass through.

Optionally, in the overspeed governor assembly, a sidewall of the opening at the rear end of the actuator seat is provided with a notch, the support pin is provided with a stopper to fit into the notch, and the notch is configured to allow the actuator seat to rotate between the first position and the second position.

Optionally, in the overspeed governor assembly, the actuator is an electromagnet, and the electromagnet includes a core rod and a buffer sleeve disposed at an end of the core rod.

Optionally, in the overspeed governor assembly, the overspeed protection switch includes: a triggering member, wherein the triggering member is in an untriggered position when the governor assembly is in normal operation, and the triggering member is capable of rotating to a triggering position from the untriggered position when toggled by the centrifugal mechanism of the overspeed governor assembly in case of overspeed of the overspeed governor assembly; and at least one protrusion connected to the triggering member and rotating with the triggering member; wherein the reset lever acts on one of the at least one protrusion during the rotation, so as to drive the triggering member to return from the triggering position to the untriggered position.

Optionally, in the overspeed governor assembly, in the untriggered position, the triggering member is rotatable to a first triggering position in a first direction or to a second triggering position in a second direction, depending on a rotational direction of the centrifugal mechanism, wherein the at least one protrusion includes a first protrusion and a second protrusion; the reset lever contacts the first protrusion in the first triggering position and drives the triggering member to return from the first triggering position to the untriggered position, and the reset lever contacts the second protrusion in the second triggering position and drives the triggering member to return from the second triggering position to the untriggered position.

Optionally, the overspeed governor assembly is a car mounted overspeed governor assembly.

An elevator system is also provided, which includes the overspeed governor assembly according to an embodiment of the present disclosure.

The remote triggering device according to an embodiment of the present disclosure may share an actuator with the overspeed protection switch, thereby saving the cost of the overspeed governor assembly.

BRIEF DESCRIPTION OF THE DRAWINGS

The contents of the present disclosure will become more easily understood with reference to the accompanying drawings. Those skilled in the art can readily appreciate that the drawings are for illustrative purposes only, instead of being intended to limit the scope of protection of the present disclosure. In addition, similar numbers in the drawings are used to indicate similar parts, wherein.

DETAILED DESCRIPTION OF THE EMBODIMENT(S) OF THE INVENTION

It will be readily understood that, based on the technical solutions of the present disclosure, those skilled in the art can propose various alternative embodiments and implementations without departing from the true spirit of the present disclosure. Therefore, the following detailed description and the accompanying drawings are merely exemplary description of the technical solutions of the present disclosure, which shall not be deemed as the whole of the present disclosure or as limiting or restricting the technical solutions of the present disclosure.

Such orientation terms as upper, lower, left, right, front, rear, front side, back side, top, bottom or the like that are mentioned or may be mentioned in this description are defined with respect to the configurations shown in the individual drawings. They are relative concepts and thus possibly vary according to their different locations and different usage states. Therefore, these or other orientation terms shall not be interpreted as limiting terms.

Figure 1:
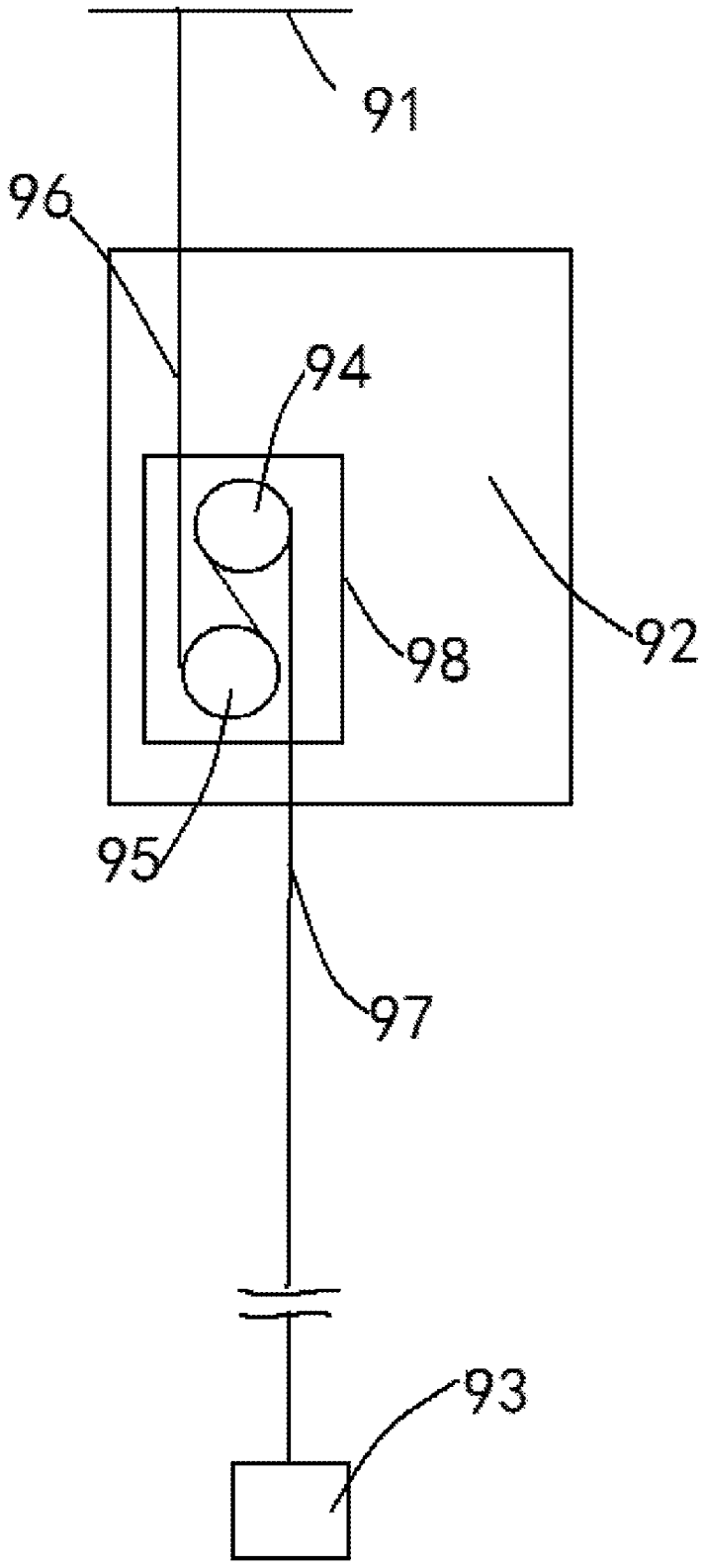
FIG. 1 shows a schematic view of an elevator system according to an embodiment.
Figure 2:
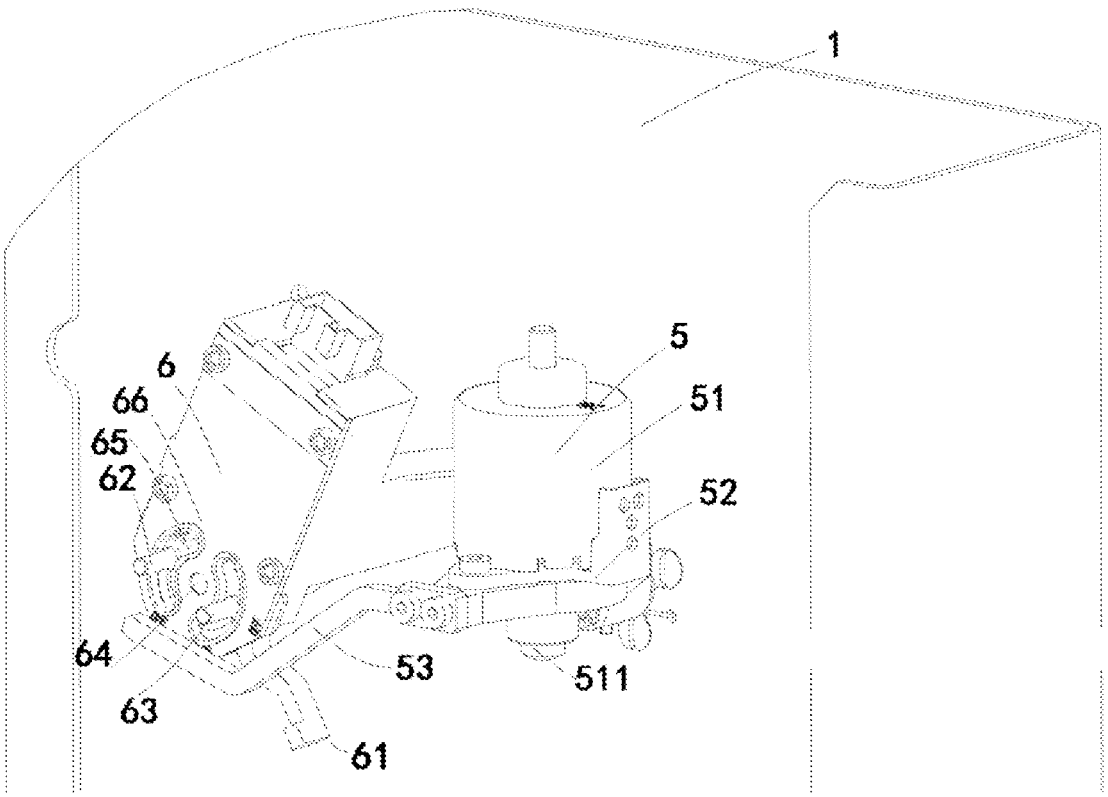
FIG. 2 shows a perspective view of a remote triggering device and an overspeed protection switch according to an embodiment.
Figure 7:
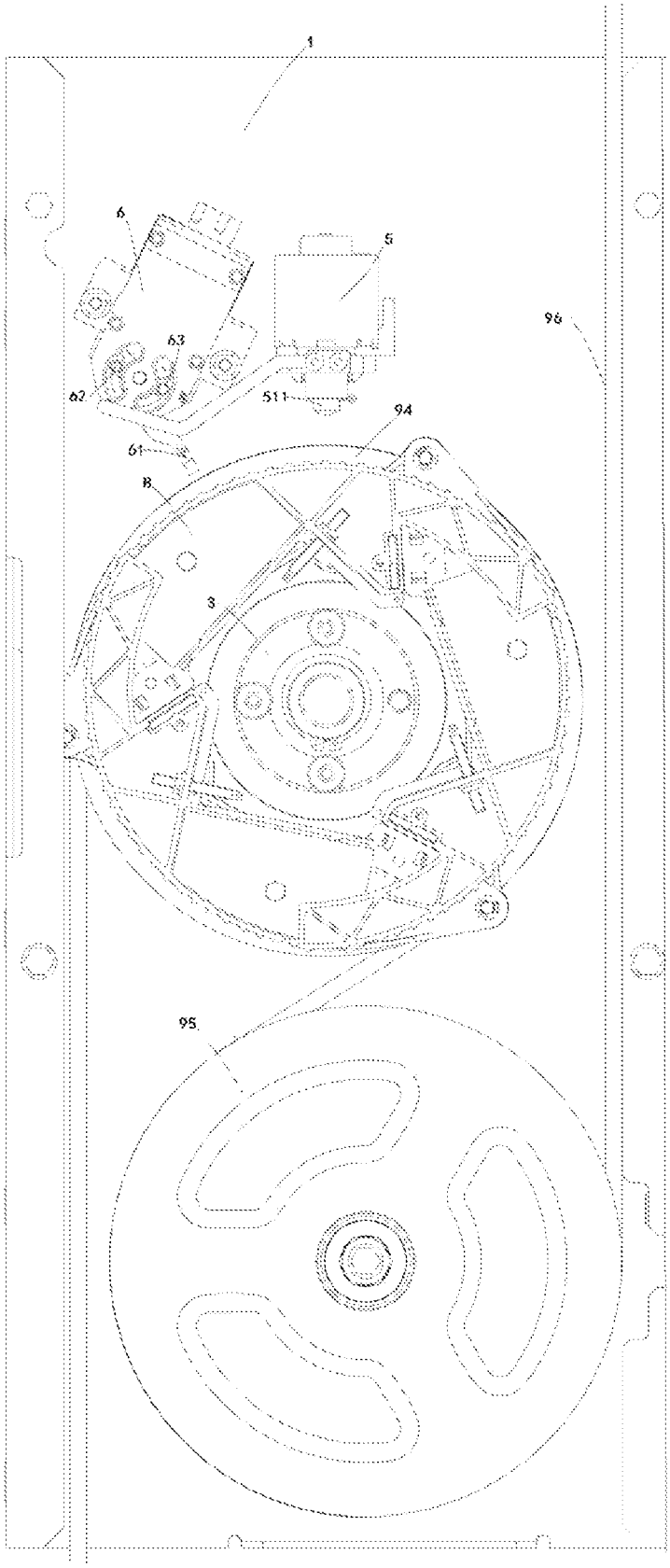
FIG. 7 shows a view of an overspeed governor assembly according to an embodiment in an untriggered state.

Referring first to FIGS. 1 and 7, schematic views of an elevator system having a car mounted overspeed governor assembly and an overspeed governor assembly are shown respectively. It should be understood that although various embodiments of the present disclosure are described with respect to a car mounted overspeed governor assembly, the device of the present disclosure can be used for various types of overspeed governors, which are not limited to the types given in the various views or embodiments. A car 92 is shown in FIG. 1 with an overspeed governor assembly 98 mounted thereon. For a typical overspeed governor assembly 98, reference may be made to the type recorded in U.S. Patent Publication No. US20130098711A1 published on Apr. 25, 2013 and filed by Otis Elevator Company, which is incorporated herein by reference in its entirety. The overspeed governor assembly 98 includes a guide pulley 95 and a governor sheave 94. A rope suspended from a hoistway top 91 wraps around the guide pulley 95 and the governor sheave 94. The rope has an upstream governor rope portion 96 and a downstream governor rope portion 97, and lengths of the upstream governor rope portion 96 and the downstream governor rope portion 97 are constantly changing during the ascending or descending process of the car. At the bottom of the hoistway, a bottom end of the downstream governor rope portion 97 is suspended with a weight 93 or connected to a pulling device that provides a tension on the rope. During the ascending and descending of the car 92, the guide pulley 95 and the governor sheave 94 will rotate due to friction with the rope. A pitch rotational linear velocity of the governor sheave 94 coincides with the car running speed. When the ascending or descending speed of the elevator car exceeds a critical value, a centrifugal mechanism 8 associated with the governor sheave 94 is unfolded under the action of a rotating centrifugal force, and contacts and toggles a triggering end 61 of an overspeed protection switch 6 when the rotational speed reaches a first speed, thereby triggering an electrical brake device, cutting off power supply to an elevator drive motor, and braking and stopping a drive sprocket. The elevator is also provided with additional protection measures. That is, when the rotational speed of the sheave exceeds a second speed greater than the first speed, the centrifugal mechanism 8 is further unfolded under the action of centrifugal force, so that rollers 84 on an inner side of the centrifugal mechanism 8 contacts a core ring 3 (see FIG. 10) to drive the core ring 3 to rotate, thereby triggering a mechanical brake device (such as a safety clamp) that brakes and stops the elevator car by a friction with a guide rail. After the elevator car is stopped and the elevator is serviced, the centrifugal mechanism 8 be restored to a normal state by itself due to a spring mechanism disposed inside it. For the overspeed protection switch 6, a reset mechanism is required to restore it to an untriggered state. In an existing structure, the overspeed protection switch 6 itself is provided with an actuator such as an electromagnet for resetting the triggering end 61 of the overspeed protection switch 6.

On the other hand, the overspeed governor assembly generally also includes a remote triggering device 5, such as the type described in the Chinese utility model No. ZL201621141734.2, entitled "Remote Triggering Device, Speed Governor Assembly and Elevator", filed by Otis Elevator Company, which is incorporated herein by reference in its entirety. The remote triggering device 5 has an action end 511, and the operator may actively control the action end 511 to move between a retracted position and an extended position. In the extended position, the action end 511 of the remote triggering device 5 acts on the centrifugal mechanism 8, and an external force causes the centrifugal mechanism 8 to unfold and trigger the electrical brake device and the mechanical brake device, thus making it possible to actively trigger the overspeed governor assembly for purposes of testing for example without overspeed of the car.

A remote triggering device 5 and an overspeed protection switch 6 according to an embodiment of the present disclosure will now be described in detail with reference to FIGS. 2 to 6. In the remote triggering device 5 according to the embodiment of the present disclosure, a remote reset function of the elevator overspeed protection switch and a remote triggering function of the overspeed governor may be integrated. Specifically, the remote triggering device 5 includes an actuator seat 52 mounted to a fixed bracket 1 and rotatable between a first position shown in FIG. 2 and a second position shown in FIG. 13; an actuator 51 disposed on the actuator seat 52 and having an action end 511 movable between a retracted position (shown in FIG. 2 or 7) and an extended position (shown in FIG. 8); and a reset lever 53 extending from the actuator seat 52.

Figure 3:
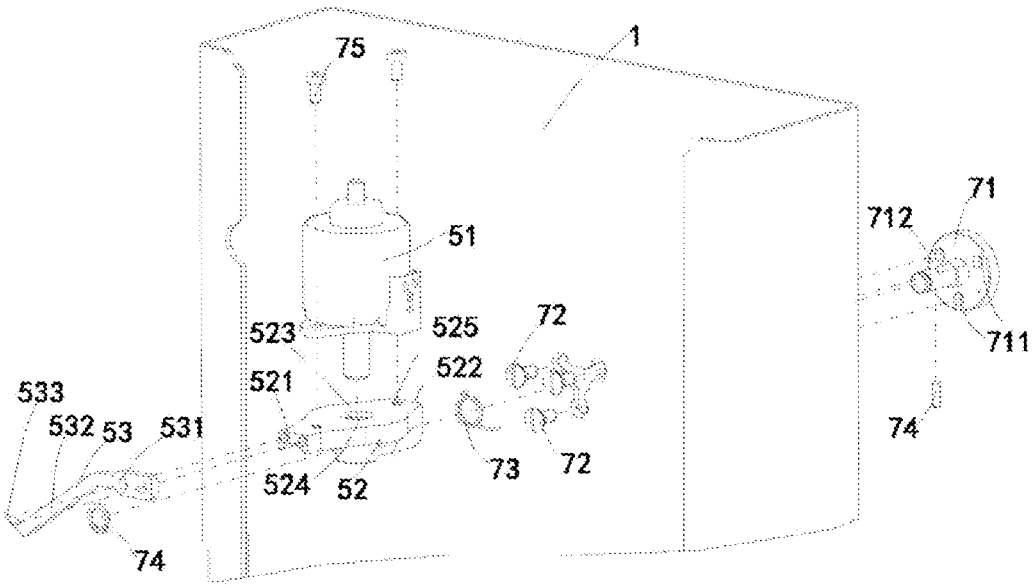
FIG. 3 shows an exploded view of a remote triggering device according to an embodiment.
Figure 4:
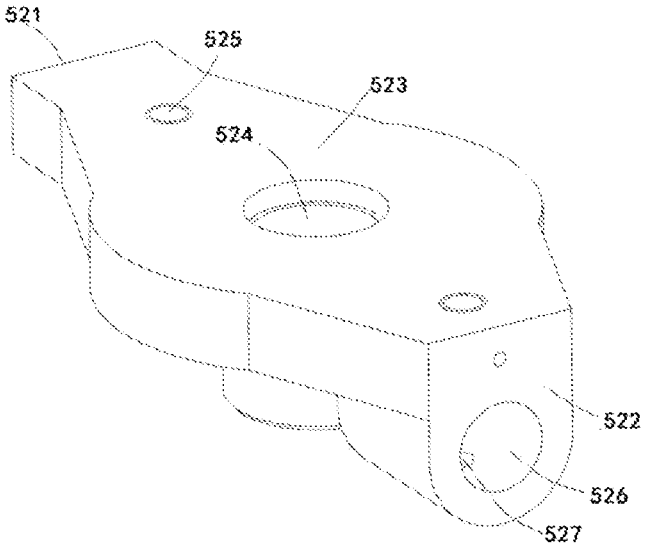
FIGS. 4 and 5 show perspective views of an actuator seat according to an embodiment from different angles.
Figure 5:
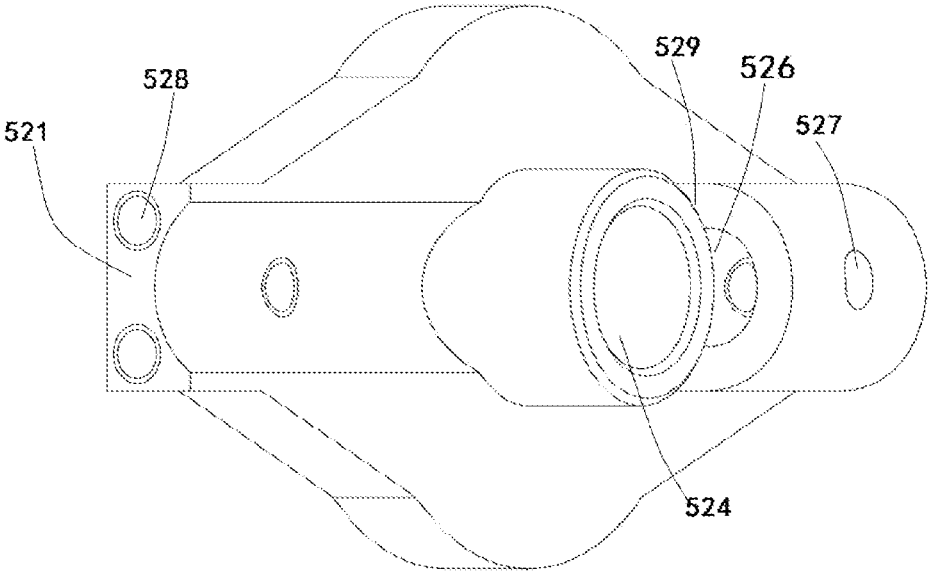
Figure 6:
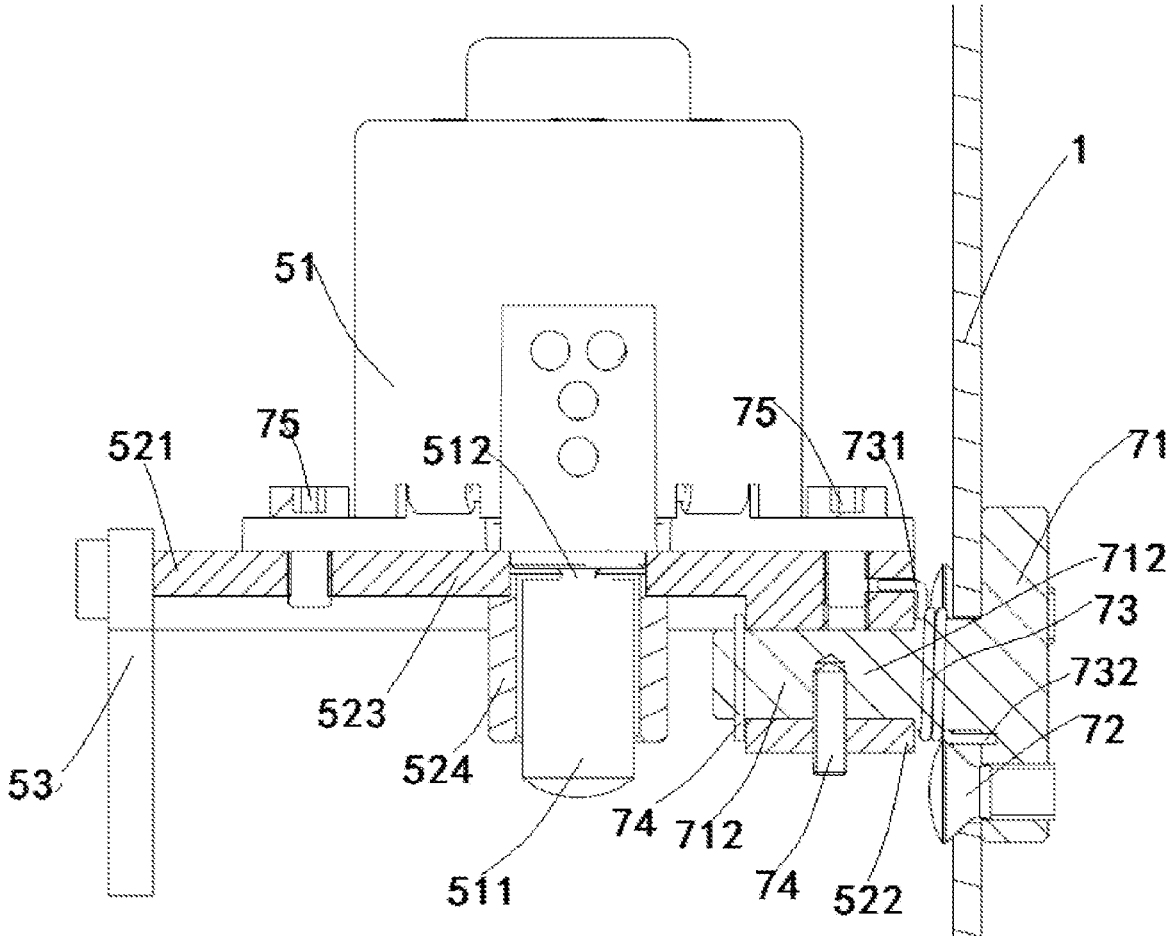
FIG. 6 shows a longitudinal sectional view of a remote triggering device according to an embodiment.

Referring to FIGS. 3 to 5, in some embodiments, the actuator seat 52 has a front end 521, a rear end 522, and a middle portion 523, and the rear end 522 of the actuator seat 52 has an opening 526. On the other hand, a support pin may be formed on the fixed bracket 1. Alternatively, the support pin may be mounted to the fixed bracket 1. For example, a support pin member 71 is fixed to the fixed bracket 1 via bolts 72 passing through openings in the fixed bracket 1 from a front side of the fixed bracket 1 and received by a mounting hole 711 of the support pin member 71 on a rear side of the fixed bracket 1. A support pin portion 712 of the support pin member 71 extends through the opening in the fixed bracket 1 to the front side of the fixed bracket 1. The actuator seat 52 is mounted to the support pin portion 712 of the fixed bracket 1 through the opening 526. In some embodiments, the actuator 51 is fixed to the middle portion 523 of the actuator seat 52. The actuator 51 is mounted to the actuator seat 52 by for example bolts 75 fitted into the bolt holes 525 at the middle portion 523 of the actuator seat 52. The middle portion of the actuator seat 52 is provided with an opening 524 to allow the action end 511 of the actuator 51 to pass through. In some embodiments, the reset lever 53 is fixedly connected to the front end 521 of the actuator seat 52, such as connected by bolts fitted into bolt holes in the front end of the actuator seat 52. In the illustrated embodiment, the reset lever 53 has a mounting portion 531, a transition section 532 and an action section 533, and for the arrangement thereof, the reset lever 53 can have any other suitable configurations. In alternative embodiments, the actuator seat 52 and the reset lever 53 may have other configurations as well.

With continued reference to FIG. 5, in the illustrated embodiment, both the vertical opening 524 and the horizontal opening 526 of the actuator seat 51 are defined by cylindrical walls with a spacing 529 therebetween. As can be seen in the cross-sectional view of FIG. 6, an end of the support pin 712 passes through the opening 526 and engages with a snap 74 at the spacing 529, thereby being axially positioned. In some embodiments, a side wall of the opening 526 at the rear end 522 of the actuator seat 52 is provided with a notch 527, the support pin 712 is provided with a stopper 74, and the stopper 74 may be inserted into the opening 526 and then mounted to the support pin 712 through the notch 527, such as threaded onto the support pin 712. The stopper 74 is fitted into the notch 527, and the notch 527 is disposed in a strip shape to define a range of movement of the stopper 74, thereby defining a range of rotation of the actuator seat 52 relative to the support pin 712. In some embodiments, the notch 527 is configured to allow the actuator seat 52 to move only between a first position and a second position; that is, in the first position and the second position, the stopper 74 contacts two ends of the notch 527 respectively. In some embodiments, the actuator seat 52 is provided with a return spring 73 so that the actuator seat 52 tends to return to the first position. As is more clearly seen from the cross-sectional view of FIG. 6, the rear end 522 of the actuator seat 52 is provided with a return torsion spring 73, wherein a first end 731 of the return torsion spring 73 is fixed to the rear end 522 of the actuator seat 52, and a second end 732 of the return torsion spring 73 is fixed to the support pin member 712, so that the return torsion spring 73 tends to return the actuator seat to the first position. In some embodiments, the actuator 51 may be an electromagnet. In some embodiments, the electromagnet includes a core rod and a buffer sleeve disposed at an end of the core rod to prevent the action end of the electromagnet from having a rigid impact with the centrifugal mechanism. It should be understood that although the actuator seat 52 in the embodiment of the present disclosure has a particular configuration, the actuator seat 52 should be understood broadly to be of any configuration capable of supporting or accommodating the actuator 51. For example, the actuator seat 52 may also be formed in the form of an outer casing of the actuator 51, such as an outer casing of an electromagnet.

Figure 8:
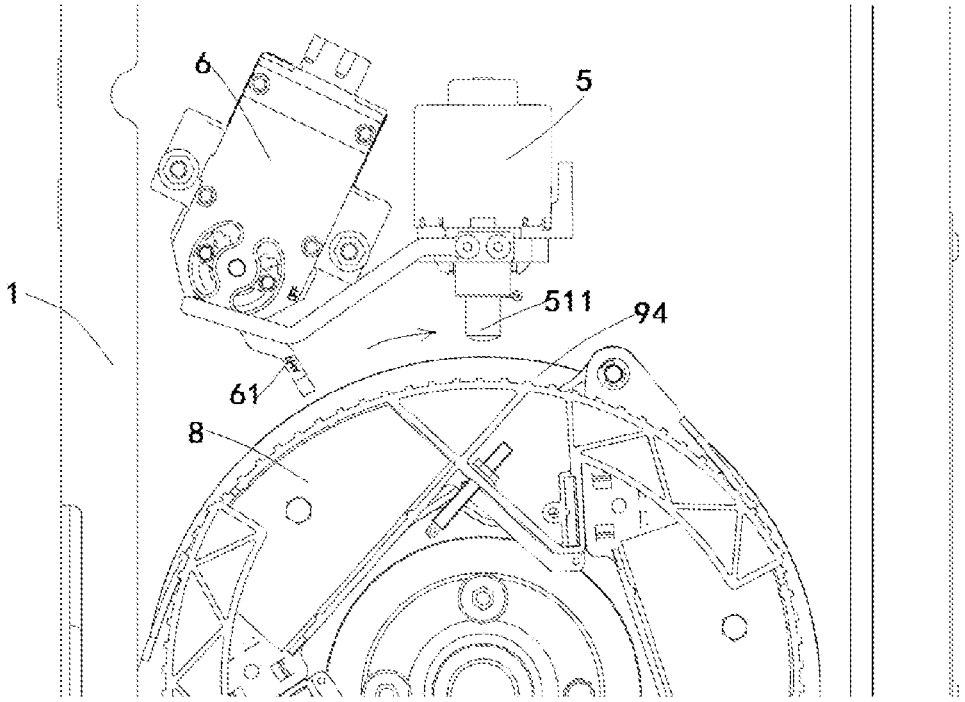
FIGS. 8 to 10 show views of a remote triggering device according to an embodiment in different states of performing a remote triggering process.
Figure 9:
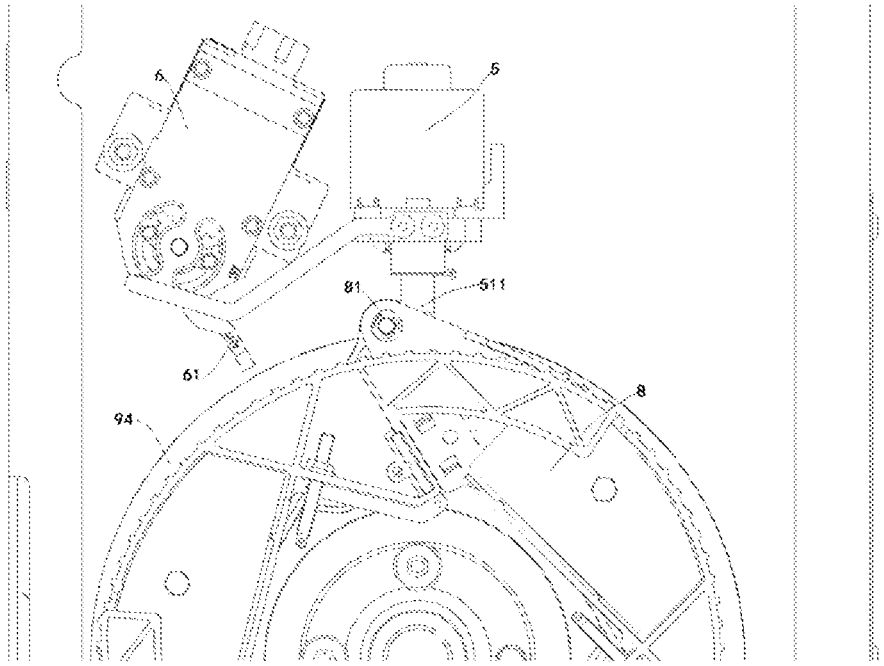
Figure 10:
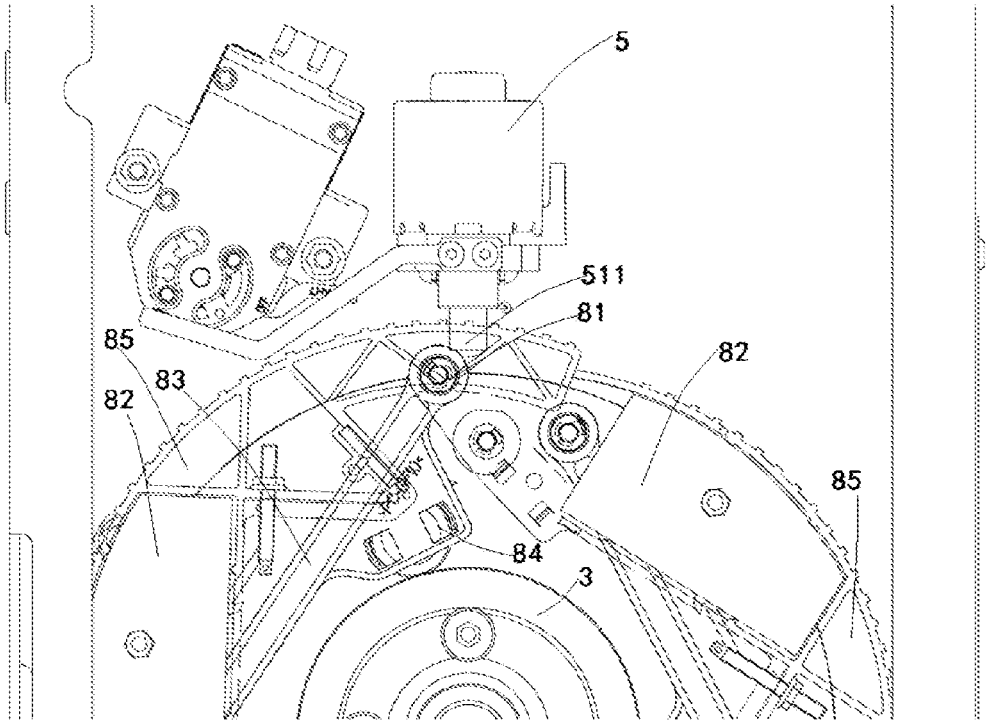

How the remote triggering device 5 functions to remotely trigger the overspeed governor will now be described with reference to FIGS. 8 to 10. If it is needed to operate a remote triggering for the purpose of testing overspeed governor or brake device, the car may descend at a normal speed. At this point, as shown in FIG. 8, the sheave 94 and the centrifugal mechanism 8 on the sheave rotate in a second direction or clockwise. The remote triggering device 5 is in the first position, wherein when the action end 511 of the actuator 51 is extended to the extended position, as shown in FIGS. 9 and 10, the remote triggering device cannot rotate counterclockwise (it can only rotate clockwise to the second position), the action end 511 of the actuator 51 acts on the centrifugal mechanism 8, such as at a connection position of connecting rods of the centrifugal mechanism 8. The centrifugal mechanism 8 is unfolded by an external force, thereby triggering the overspeed governor assembly, including enabling an outer edge of the centrifugal mechanism to trigger the overspeed protection switch 61, thereby triggering the electrical brake device and/or making the rollers 84 on the inner side the centrifugal mechanism 8 contact with the core ring 3, which triggers the mechanical brake device. It can thus be seen that the remote triggering device according to the present disclosure can trigger the overspeed governor assembly as a conventional remote triggering device does.

Figure 11:
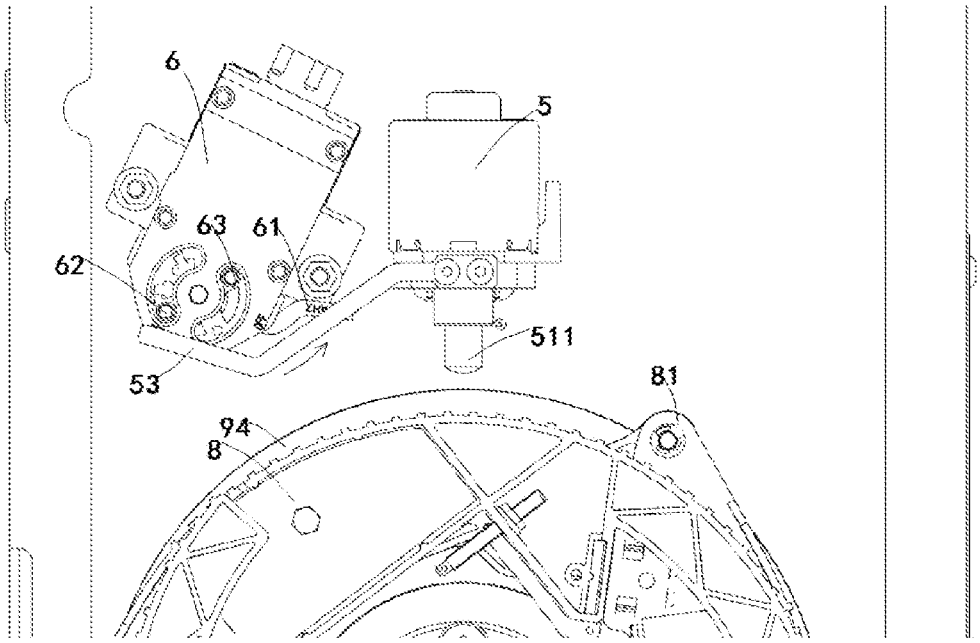
FIGS. 11 to 14 show schematic views of a process of an overspeed governor assembly according to an embodiment of the present disclosure in which a triggering member of an overspeed protection switch is returned to an untriggered position from a first triggering position.
Figure 12:
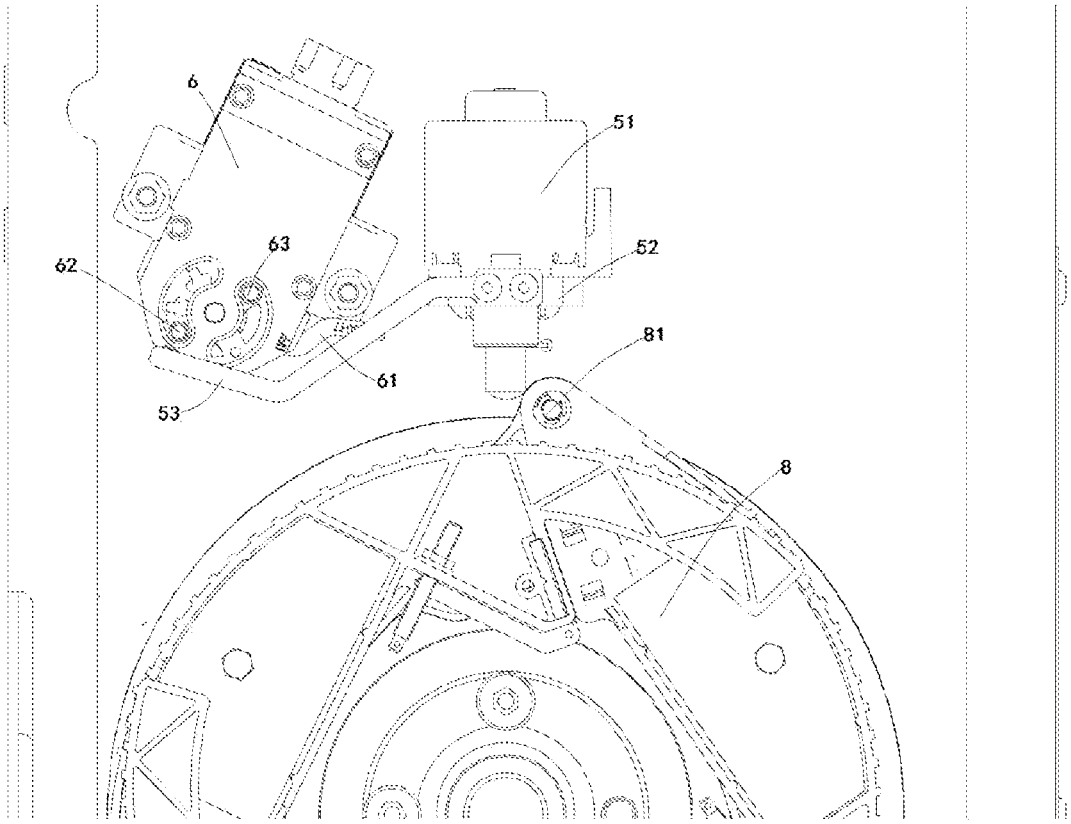
Figure 13:
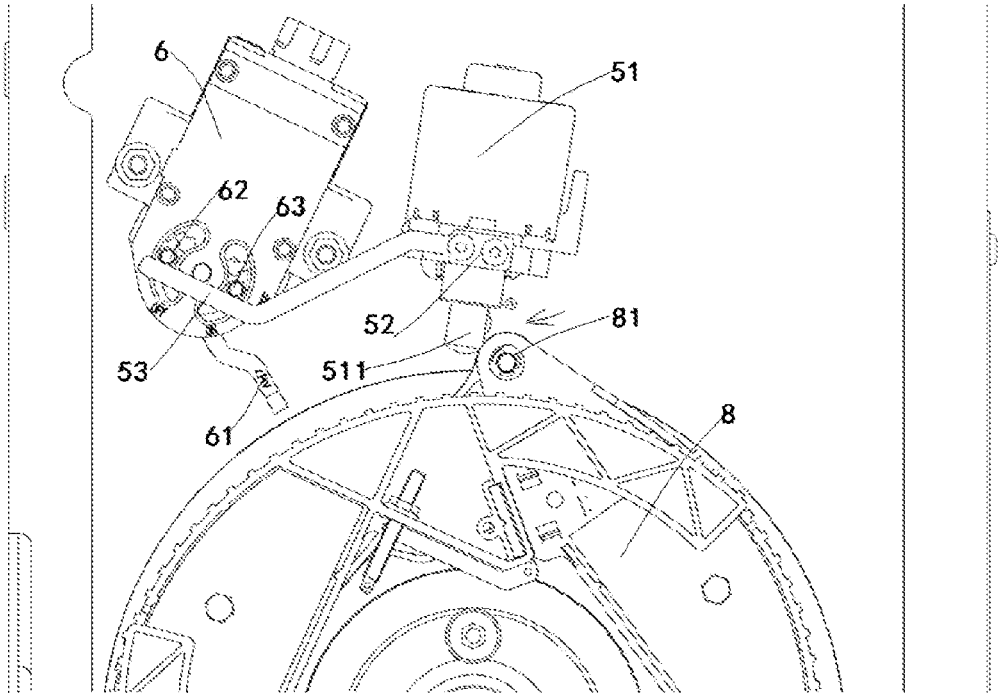

How the remote triggering device 5 function to reset the overspeed protection switch will be described with continued reference to FIGS. 11 to 16. As shown in FIG. 11, after the car has descended and has exceeded the first speed, the centrifugal mechanism on the overspeed governor sheave 94 toggles the triggering end 61 of the overspeed protection switch 6 so that the triggering end 61 rotates as indicated by the arrow in FIG. 11 from an untriggered position shown in FIG. 7 to a first triggered position shown in FIG. 11. After performing the necessary maintenance on the elevator system, it is necessary to restore the overspeed protection switch 6 so that the triggering end 61 thereof returns to the untriggered position. To achieve the above object, the elevator car may be operated to ascend at a detection speed (a lower speed), thereby causing the overspeed governor sheave and the centrifugal mechanism 8 to rotate in a first direction corresponding to the ascending of the car, such as the counterclockwise direction shown in FIG. 11, and then moving the action end 511 of the actuator 51 to the extended position. As shown in FIGS. 12 and 13, the centrifuge mechanism 8 of the overspeed governor assembly contacts the action end 511 of the actuator 51 and drives the actuator 51, the actuator seat 52 and the reset lever 53 to rotate together. The rotation of the reset lever 53 acts on the overspeed protection switch 6 so that the overspeed protection switch 6 is reset, i.e., returning to the untriggered position. The action end 511 of the rotating actuator 51 will allow the centrifugation mechanism 8 to pass through.

In some embodiments, the overspeed protection switch 6 includes a triggering member 61 that is in an untriggered position (FIG. 7) when the overspeed governor assembly is in normal operation, and the triggering member can be toggled by the centrifugal mechanism of the overspeed governor assembly in case of overspeed of the overspeed governor assembly so that the triggering member is rotated from the untriggered position to a triggering position. In some embodiments, the overspeed protection switch 6 may further include at least one protrusion 62, 63 connected to the triggering member 61 and rotating with the triggering member 61, and the reset lever acts on one of the at least one protrusion 62, 63 during the rotation, thereby driving the triggering member 61 to return from the triggering position to the untriggered position. In some embodiments, in a case that the triggering member 61 is in the untriggered position, depending on the rotational direction of the centrifugal mechanism 8, such as when the centrifugal mechanism 8 is rotated in a second direction corresponding to descending of the car and exceeds a certain speed, the centrifugal mechanism toggles the triggering member 61 to rotate in a first direction to a first triggering position shown in FIG. 11, and such as when the centrifugal mechanism 8 is rotated in a first direction corresponding to ascending of the car and exceeds a certain speed, the centrifugal mechanism toggles the triggering member to rotate in a second direction to a second triggering position shown in FIG. 15. In some embodiments, the at least one protrusion includes a first protrusion 62 and a second protrusion 63. In some embodiments, as shown more clearly in FIG. 2, the first protrusion 62 and the second protrusion 63 are connected to a rotating frame 65 which is connected to the triggering end 61, wherein the rotating frame 65, the first protrusion 62 and the second protrusion 63 extending from the rotating frame 65, and the triggering member 61 can be rotated together along a longitudinal axis 64. In some embodiments, the rotating frame 65 is accommodated in a housing 66 of the overspeed protection switch 6, the housing 66 defining arcuate slots, wherein the first protrusion 62 and the second protrusion 63 extend forwardly from the arcuate slots, and the triggering member 61 extends from a side of the housing 66.

Figure 14:
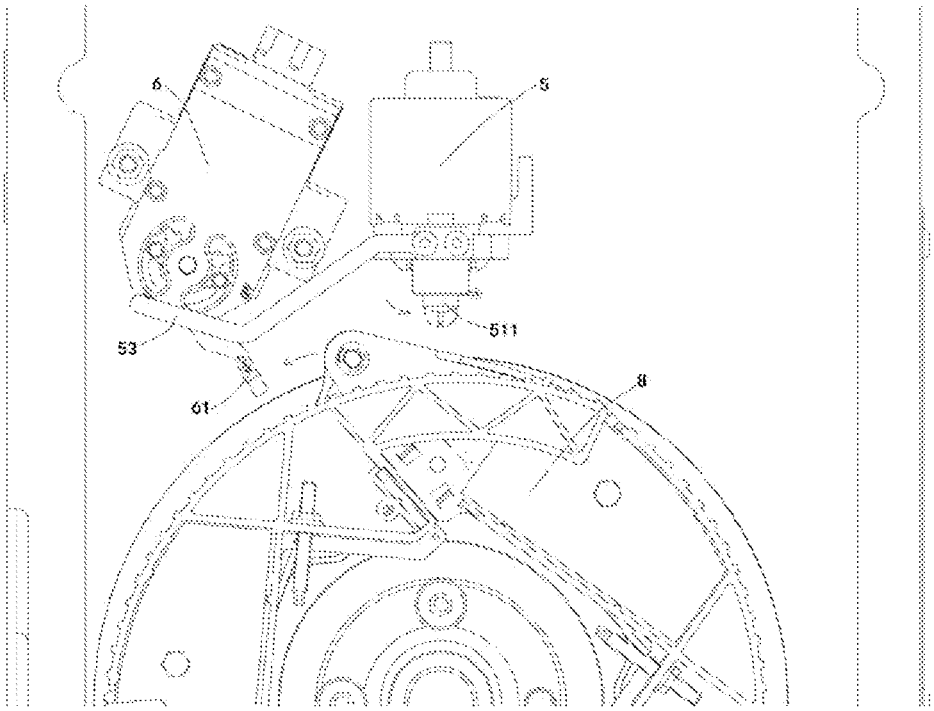
Figure 15:
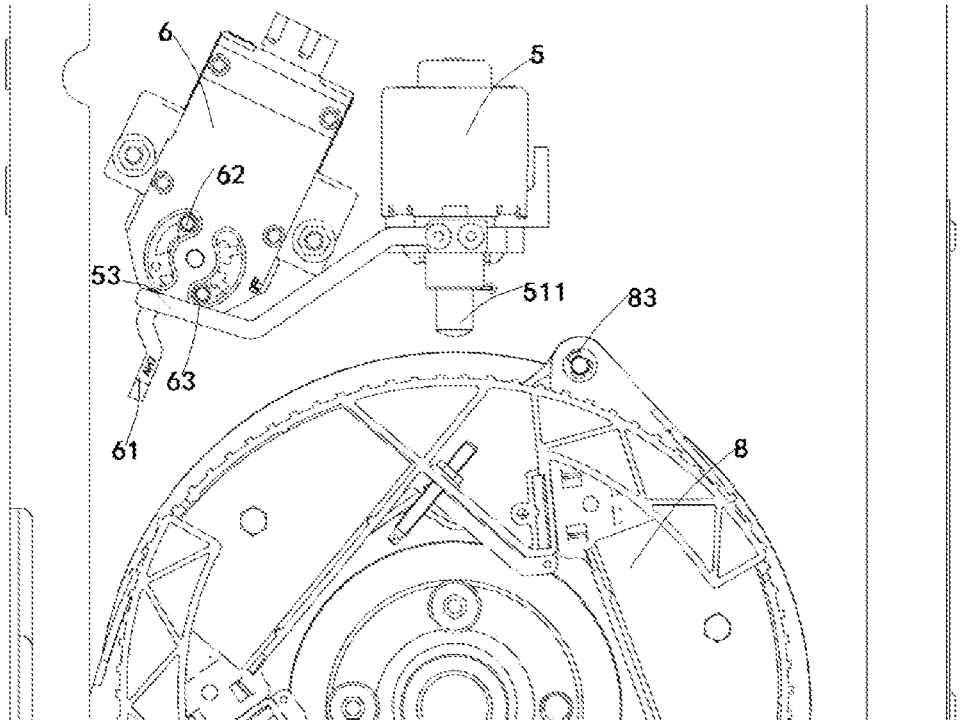
FIGS. 15 and 16 show schematic views of a process of an overspeed governor assembly according to an embodiment of the present disclosure in which a triggering member of an overspeed protection switch is returned to an untriggered position from a second triggering position.
Figure 16:
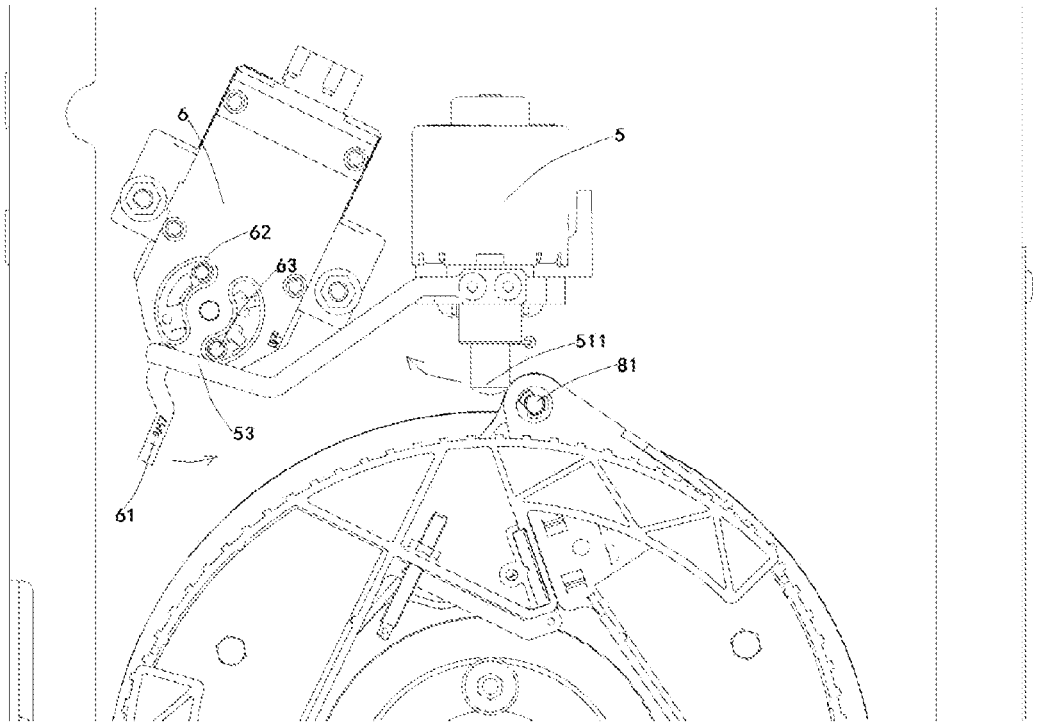

In the first triggering position shown in FIG. 11, as the centrifugal mechanism 8 rotates in the first direction, an outer edge of the centrifugal mechanism (such as a connection position 81 of connecting rods) contacts and acts on the action end 511 of the actuator 51 of the remote triggering device 5 (FIG. 12) so that the actuator seat 52 of the remote triggering device 5 drives the reset lever 53 to rotate therewith. The rotation of the reset lever 53 will act on the first protrusion 62 of the overspeed protection switch 6, and will drive the triggering member 61 to return from the first triggering position to the untriggered position shown in FIG. 13. After the rotation, the action end 511 of the actuator 51 will allow the outer edge of the centrifugation mechanism 8 to pass through. Subsequently, due to the action of the return spring, the actuator seat will drive the reset lever and the actuator as a whole to rotate from the second position to the first position, as shown in FIG. 14. With continued reference to FIGS. 15 and 16, after the triggering member is rotated in the second direction to the second triggering position (FIG. 15), as the centrifugal mechanism 8 is rotated in the first direction, the outer edge of the centrifugal mechanism contacts and acts on the action end 511 of the actuator 51 of the remote triggering device 5 (FIG. 16) to drive the actuator seat 52 to rotate to the second position. Similarly, as the actuator seat 52 is rotated from the first position toward the second position, the reset lever 53 will act on the second protrusion 63 of the overspeed protection switch in the second triggering position and will drive the triggering member 61 to return to the untriggered position (similar to that shown in FIG. 13). After the rotation, the action end 511 of the actuator 51 will allow the outer edge of the centrifuge mechanism 8 to pass through. Subsequently, due to the action of the return spring, the remote triggering device 5 as a whole will rotate back to the first position from the second position (similar to that shown in FIG. 14).

In another aspect, the present disclosure also provides an overspeed governor assembly that can be a car mounted overspeed governor assembly or other types of overspeed governor assemblies, including the remote triggering device according to various embodiments of the present disclosure.

In another aspect, an elevator system is provided, which includes the overspeed governor assembly according to various embodiments of the present disclosure.

The remote triggering device 5 and the overspeed protection switch 6 according to the embodiments of the present disclosure may share one actuator 51, thereby eliminating the need for a separate actuator for resetting the overspeed protection switch 6, and reducing the cost of the entire overspeed governor assembly.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. It should be understood that these modifications or changes should be included within the scope of protection of the present disclosure.

What is claimed is:

1. A remote triggering device for an overspeed governor assembly having an overspeed protection switch, comprising:

an actuator seat mounted on a fixed bracket and rotatable between a first position and a second position;

an actuator disposed on the actuator seat and having an action end movable between a retracted position and an extended position, wherein the actuator includes an electromagnet; and a reset lever extending from the actuator seat;

wherein in a case that a centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position toward the second position, and the reset lever rotates with the actuator seat, wherein in the second position the reset lever contacts the overspeed protection switch so that the overspeed protection switch is returned to an untriggered position.

2. The remote triggering device according to claim 1, wherein in a case that the centrifugal mechanism of the overspeed governor assembly rotates in a second direction corresponding to descending of the elevator car, when the action end of the actuator is in the extended position, the actuator seat is in the first position, and the action end of the actuator acts on the centrifugal mechanism, thereby triggering the overspeed governor assembly.

3. The remote triggering device according to claim 1, wherein the actuator seat is provided with a return spring so that the actuator seat tends to return to the first position.

4. The remote triggering device according to claim 1, wherein the actuator seat has a front end and a rear end, and the rear end of the actuator seat has an opening to be mounted to a support pin on the fixed bracket.

5. The remote triggering device according to claim 4, wherein the reset lever is fixedly connected to the front end of the actuator seat.

6. The remote triggering device according to claim 4, wherein the actuator is fixed to a middle portion of the actuator seat, and the middle portion of the actuator seat is provided with an opening to allow the action end of the actuator to pass through.

7. The remote triggering device according to claim 4, wherein a sidewall of the opening at the rear end of the actuator seat is provided with a notch, the support pin is provided with a stopper to fit into the notch, and the notch is configured to allow the actuator seat to rotate between the first position and the second position.

8. An overspeed governor assembly, comprising:

a fixed bracket;

a sheave mounted on the fixed bracket;

a centrifugal mechanism mounted on the sheave and rotating with the sheave;

an overspeed protection switch on a radially outer side of the centrifugal mechanism; and a remote triggering device on the radially outer side of the centrifugal mechanism and adjacent to the overspeed protection switch, the remote triggering device comprising:

an actuator seat mounted on the fixed bracket and rotatable between a first position and a second position;

an actuator disposed on the actuator seat and having an action end movable between a retracted position and an extended position, wherein the actuator includes an electromagnet; and a reset lever extending from the actuator seat;

wherein in a case that the centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position to the second position, and the reset lever rotates with the actuator seat, and wherein in the second position the reset lever contacts the overspeed protection switch so that the overspeed protection switch is returned to an untriggered position.

9. The overspeed governor assembly according claim 8, wherein in a case that the centrifugal mechanism of the overspeed governor assembly rotates in a second direction corresponding to descending of the elevator car, when the action end of the actuator is in the extended position, the actuator seat is in the first position, and the action end of the actuator acts on the centrifugal mechanism, thereby triggering the overspeed governor assembly.

10. The overspeed governor assembly according claim 8, wherein the actuator seat is provided with a return spring so that the actuator seat tends to return to the first position.

11. The overspeed governor assembly according claim 8, wherein the actuator seat has a front end and a rear end, and the rear end of the actuator seat has an opening to mount to a support pin on the fixed bracket.

12. The overspeed governor assembly according claim 11, wherein the reset lever is fixedly connected to the front end of the actuator seat.

13. The overspeed governor assembly according claim 11, wherein the actuator is fixed to a middle portion of the actuator seat, and the middle portion of the actuator seat is provided with an opening to allow the action end of the actuator to pass through.

14. The overspeed governor assembly according claim 11, wherein a sidewall of the opening at the rear end of the actuator seat is provided with a notch, the support pin is provided with a stopper to fit into the notch, and the notch is configured to allow the actuator seat to rotate between the first position and the second position.

15. An overspeed governor assembly, comprising:

a fixed bracket;

a sheave mounted on the fixed bracket;

a centrifugal mechanism mounted on the sheave and rotating with the sheave;

an overspeed protection switch on a radially outer side of the centrifugal mechanism; and a remote triggering device on the radially outer side of the centrifugal mechanism and adjacent to the overspeed protection switch, the remote triggering device comprising:

an actuator seat mounted on the fixed bracket and rotatable between a first position and a second position;

an actuator disposed on the actuator seat and having an action end movable between a retracted position and an extended position; and a reset lever extending from the actuator seat;

wherein in a case that the centrifugal mechanism of the overspeed governor assembly rotates in a first direction corresponding to ascending of an elevator car, when the action end of the actuator moves to the extended position, the centrifugal mechanism of the overspeed governor assembly contacts the action end of the actuator and drives the actuator seat to rotate from the first position to the second position, and the reset lever rotates with the actuator seat, and wherein in the second position the reset lever contacts the overspeed protection switch so that the overspeed protection switch is returned to an untriggered position;

wherein the overspeed protection switch comprises:

a triggering member, wherein the triggering member is in a untriggered position when the overspeed governor assembly is in normal operation, and the triggering member is capable of rotating to a triggering position from the untriggered position when toggled by the centrifugal mechanism of the overspeed governor assembly in case of overspeed of the overspeed governor assembly; and at least one protrusion connected to the triggering member and rotating with the triggering member;

wherein the reset lever acts on one of the at least one protrusion during the rotation, so as to drive the triggering member to return from the triggering position to the untriggered position.

16. The overspeed governor assembly according claim 15, wherein in the untriggered position, the triggering member is rotatable to a first triggering position in a first direction or to a second triggering position in a second direction, depending on a rotational direction of the centrifugal mechanism, and wherein the at least one protrusion comprises a first protrusion and a second protrusion; the reset lever contacts the first protrusion in the first triggering position and drives the triggering member to return from the first triggering position to the untriggered position, and the reset lever contacts the second protrusion in the second triggering position and drives the triggering member to return from the second triggering position to the untriggered position.

17. The overspeed governor assembly according claim 16, wherein the overspeed governor assembly is a car mounted overspeed governor assembly.

18. An elevator system, comprising the overspeed governor assembly according to claim 8.

* * * * *